United States Patent [19]

Gause

[11] 3,952,917

[45] Apr. 27, 1976

[54] PERFUME OR COLOGNE DISPENSER

[75] Inventor: Lawrence J. Gause, Bakersfield, Calif.

[73] Assignee: Otho C. Crouse, Bakersfield, Calif. ; a part interest

[22] Filed: Jan. 8, 1975

[21] Appl. No.: 539,525

[52] U.S. Cl. ..... 222/78; 63/1 A; 206/235; 206/45.15; 239/211

[51] Int. Cl.[2] ..... A44C 15/00

[58] Field of Search ..... 239/34, 36, 211, 337; 63/1 R, 1 A, 2, 20, DIG. 2; 206/235, 457, 493, 45.15, 45.18, 74, 75; 215/2, 221; 222/78, 179.5, 192, 325; 248/311

[56] References Cited

UNITED STATES PATENTS

| | | | |
|---|---|---|---|
| 1,767,911 | 6/1930 | Berko et al. | 239/211 |
| 2,169,779 | 8/1939 | Loewe | 222/179.5 X |
| 2,770,387 | 11/1956 | Loween | 206/235 X |

FOREIGN PATENTS OR APPLICATIONS

| | | | |
|---|---|---|---|
| 4,709 | 4/1885 | United Kingdom | 63/DIG. 2 |
| 1,226,366 | 7/1960 | France | 63/DIG. 2 |

*Primary Examiner*—John J. Love
*Assistant Examiner*—Andres Kashnikow
*Attorney, Agent, or Firm*—Clarence A. O'Brien; Harvey B. Jacobson

[57] ABSTRACT

A dispenser for perfume and cologne has a body member forming an ornamental setting. Removably arranged in a cavity provided in the body member is a dispensing unit for the scented substance being dispensed. The dispensing unit includes a socket arranged for receiving an arm pivotally mounted on the body member and causing the dispensing unit to be removably held within the cavity of the body member.

5 Claims, 4 Drawing Figures

PERFUME OR COLOGNE DISPENSER

BACKGROUND OF THE INVENTION

1. Field of the Invention

This invention relates generally to a dispenser, and particularly to an ornamental assembly for dispensing scented substances such as perfumes and toilet water.

2. Description of the Prior Art

It is known generally to provide costume jewelry, and the like, with masses of absorbent material which is scented by a suitable scented liquid. Examples of such prior art arrangements may be found in U.S. Pat. Nos. 130,421, issued Aug. 13, 1872 to S. Fredrick, 2,141,402, issued Dec. 27, 1938 to L. B. Muller, and 2,234,062, issued Mar. 4, 1941 to C. W. Roberts.

SUMMARY OF THE INVENTION

It is an object of the present invention to provide for a scent dispensing unit in an inconspicuous location of costume jewelry, and the like.

It is another object of the present invention to provide an improved manner of mounting a scent dispensing unit on an associated ornamental body member.

It is still another object of the present invention to provide a dispensing unit for an ornamental scent dispensing arrangement that is both capable of being easily mounted and dismounted on an associated ornamental body member and dispensing a scented substance under pressure.

These and other objects are obtained according to the present invention by providing a dispenser having: a body member forming an ornamental setting and provided with a cavity; a dispensing unit removably arranged in the cavity of the body member; and a retaining arrangement provided partially on the body member and partially on the dispenser unit for removably holding the dispenser unit within the cavity of the body member.

According to a preferred embodiment of the present invention, the retaining arrangement includes an arm pivotally mounted on the body member, and a socket provided on the dispenser unit for removably receiving the aforementioned arm. In this manner, pivotal movement of the arm will cause the dispenser unit to swing into and out of the cavity provided in the body member.

The dispenser unit according to the present invention advantageously includes a container, an outlet valve provided on the container for permitting selective dispensing of a substance in the container, and an intake valve also provided on the container for permitting selective refilling of the container with a substance to be dispensed. It will be appreciated that the arm-receiving socket will also be mounted on the aforementioned container.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
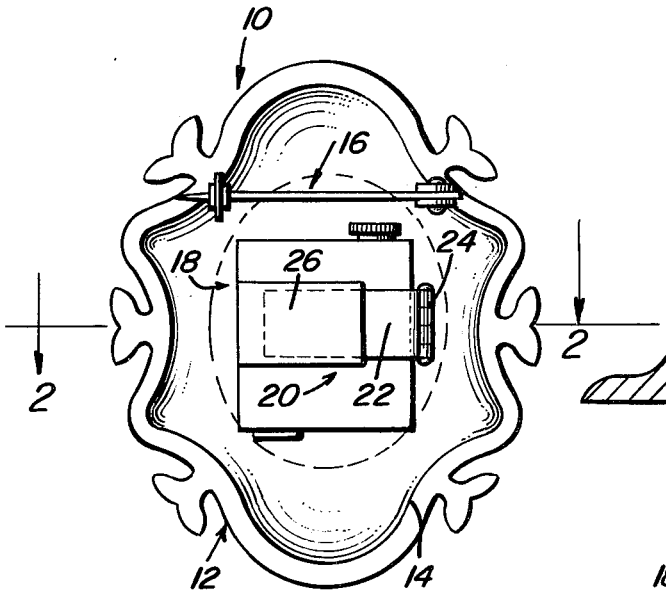
FIG. 1 is a bottom plan view of a perfume or cologne dispenser according to the present invention.
Figure 2:
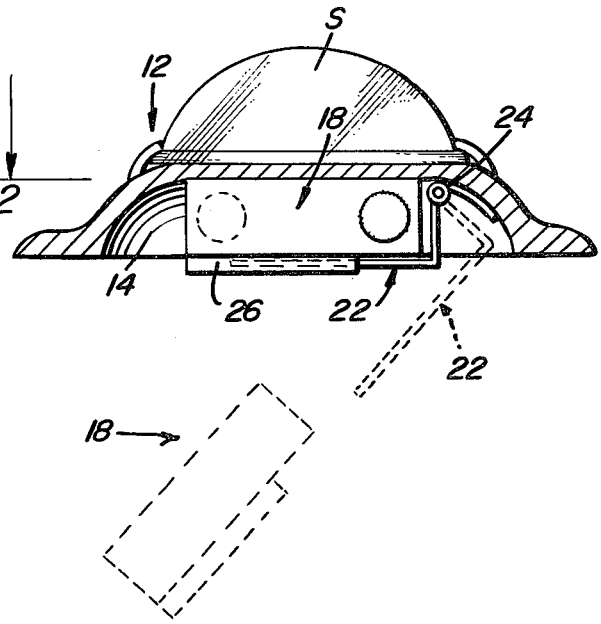
FIG. 2 is a partially sectional view taken generally along the line 2—2 of FIG. 1, but showing only the body member of the dispenser in section.

Referring now more particularly to FIGS. 1 and 2 of the drawings, a dispenser 10 according to the present invention has a body member 12 forming an ornamental setting and provided with a cavity 14. More specifically, body member 12 is in the form of a brooch provided with a suitable stone S mounted in a conventional manner. Further, a conventional clasp 16 is mounted on body member 12 so as to span the cavity 14 thereof for permitting attachment of body member 12 to a garment (not shown) and the like. A dispensing unit 18, such as to be described below, is removably arranged in cavity 14 as by a suitable retaining device 20.

Retaining device 20 advantageously includes a, for example, substantially L-shaped arm 22 pivotally mounted on body member 12, within cavity 14, as by a conventional hinge 24, and the like. A socket 26, which may be in the form of the illustrated sleeve, is provided on dispensing unit 18 for removably receiving arm 22. Thus, in the embodiment of the invention shown in FIGS. 1 and 2, dispensing unit 18 may be readily removed from its associated arm 22 as desired for replacement of the dispensing unit or placement of the dispensing unit on a different body member than that illustrated.

As will be appreciated from the above description and from the drawings, any number of suitable body members may be used with a single, uniform, dispensing unit 18. Or, contrarily, any number of dispensing units 18, each provided with a different scented substance, may be employed with a single body member 12. Thus, a dispenser according to the present invention provides great flexibility for the user as to the style of ornamentation and the particular scent employed.

As was mentioned above, dispensing unit 18 may be provided with a suitable, for example, slotted tab (not shown) and the like in place of the sleeve forming socket 26. In fact, any suitable structure may be employed for socket 26 as long as the structure employed will receive an arm such as arm 22.

Figure 3:
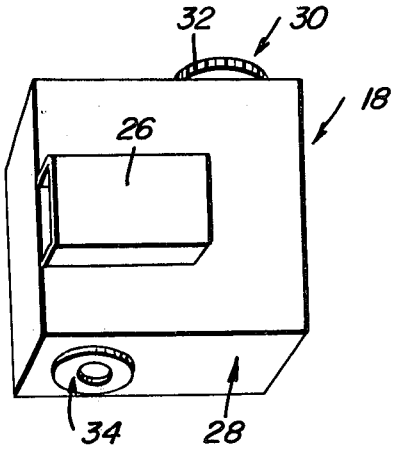
FIG. 3 is a perspective view showing a dispenser unit according to the present invention.

Referring now more particularly to FIG. 3 of the drawings, dispensing unit 18 advantageously includes a container 28, which may be of the illustrated substantially rectangular configuration. An outlet valve 30 is provided on container 28 for permitting selective dispensing of a substance in container 28 under pressure. Accordingly, container 28 is advantageously constructed as a pressure vessel. An adjustment knob 32 is provided as part of outlet valve 30 for allowing a controlled amount of the fragrance to be released from container 28. Since valves suitable for use as outlet valve 30 are known to those in the pertinent art, the details of valve 30 will not be described herein. This is also the case with intake valve 34 also provided on container 28 for permitting selective refilling of container 28 with a substance to be dispensed. It will be appreciated that valve 34 may be similar to those used in, for example, cigarette lighters, and the like, for filling same with butane and similar fuel under pressure. Further, any perfume or toilet water, such as cologne, available on the market in an air pressure container (not shown) can be used to fill dispensing unit 18. These commercially available pressurized containers are generally provided with a discharge fitting (not shown) which will mate with a conventional intake valve 34.

Figure 4:
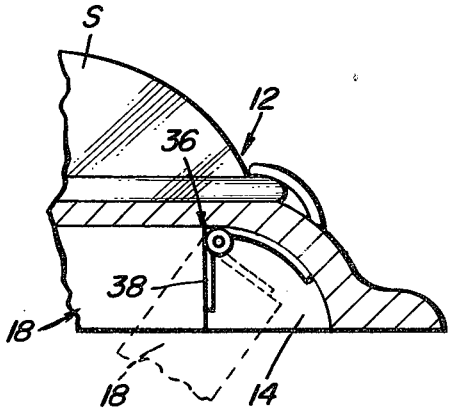
FIG. 4 is a fragmentary, partially sectional view, similar to FIG. 2, but showing a modified embodiment of the present invention.

FIG. 4 of the drawings shows a modified form of a dispenser according to the present invention wherein hinge 24 of dispenser 10 is replaced by a hinge 36 having a leaf 38 which is affixed to dispensing unit 18 in a suitable manner, such as with a conventional adhesive. Thus, although dispensing unit 18 will still swing out of cavity 14 due to the pivoting action of hinge 36, dispensing unit 18 is not readily removable from hinge 36. Otherwise, the embodiment shown in FIG. 4 functions in the same manner as the embodiment of FIGS. 1 through 3, which, as can be appreciated from the broken lines in FIG. 2 of the drawings, will swing out of cavity 14 and off of arm 22 for use and/or replacement, as desired.

It will be appreciated that as an added feature of the present invention, the provision of cavity 14 in body member 12 tends to remove unnecessary bulk from the finished device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A dispenser for perfume and cologne, comprising, in combination:

a. a body member forming an ornamental setting and provided with a cavity;

b. a dispensing unit removably arranged in the cavity of the body member; and c. retaining means for removably holding the dispensing unit within the cavity of the body member, said retaining means including an arm pivotally mounted on the body member, socket means provided on the dispensing unit for removably receiving the arm, the dispensing unit including a container, an outlet valve provided on the container for permitting selective dispensing of a substance in the container under pressure, and an intake valve also provided on the container for permitting selective refilling of the container with a substance to be dispensed.

2. A structure as defined in claim 1, wherein a clasp is mounted on the body member for attaching the body member to a garment.

3. A dispensing unit for use with a perfume and cologne dispenser, comprising, in combination:

a. a container;

b. an outlet valve provided on the container for permitting selective dispensing of a substance in the container under pressure;

c. an intake valve also provided on the container for permitting selective refilling of the container with a substance to be dispensed; and d. socket means provided on the container for receiving an arm provided on a body member partially forming the dispenser.

4. A dispenser for aromatic materials comprising, in combination:

a. an ornamental body defining a cavity;

b. an arm pivotally supported from said body and including a free end portion swingable toward and away from said body cavity;

c. an aromatic material dispensing unit, said unit and said free end portion including co-acting means removably supporting said unit from said free end portion with said unit swingable into said cavity when said free end portion is swung toward said cavity, said coacting means, said unit and the portions of said body defining said cavity coacting to prevent removal of said unit from said free end portion when said free end portion is swung to a position with said unit received in said cavity, said coacting means removably supporting said unit from said free end portion defining a telescopic connection between said unit and said free end portion.

5. A dispenser for aromatic materials comprising, in combination:

a. an ornamental body defining a cavity;

b. an arm pivotally supported from said body and including a free end portion swingable toward and away from said body cavity;

c. an aromatic material dispensing unit, said unit and said free end portion including co-acting means removably supporting said unit from said free end portion with said unit swingable into said cavity when said free end portion is swung toward said cavity, said coacting means, said unit and the portions of said body defining said cavity coacting to prevent removal of said unit from said free end portion when said free end portion is swung to a position with said unit received in said cavity, said coacting means removably supporting said unit from said free end portion includes means mounting said unit on said free end portion for longitudinal shifting therealong and removal from the terminal end of said free end portion.

* * * * *